US012295440B1

(12) United States Patent
Carlton

(10) Patent No.: US 12,295,440 B1
(45) Date of Patent: May 13, 2025

(54) HEAD CAP WITH REMOVABLE BACKSTRAP AND METHOD OF USE

(71) Applicant: Lawrence G. Carlton, Longview, TX (US)

(72) Inventor: Lawrence G. Carlton, Longview, TX (US)

( * ) Notice: Subject to any disclaimer, the term of this patent is extended or adjusted under 35 U.S.C. 154(b) by 0 days.

(21) Appl. No.: 18/642,597

(22) Filed: Apr. 22, 2024

Related U.S. Application Data

(60) Provisional application No. 63/555,188, filed on Feb. 19, 2024, provisional application No. 63/550,484, filed on Feb. 6, 2024.

(51) Int. Cl.
*A42B 1/22* (2006.01)
*A42B 1/0182* (2021.01)
*A42B 1/02* (2006.01)

(52) U.S. Cl.
CPC ..... *A42B 1/22* (2013.01); *A42B 1/0182* (2021.01); *A42B 1/02* (2013.01)

(58) Field of Classification Search
CPC ..... A42B 1/22; A42B 1/225; A42B 7/00
See application file for complete search history.

(56) References Cited

U.S. PATENT DOCUMENTS 714,198 A * 11/1902 Lacy ..... A42B 7/00 132/59
1,434,607 A * 11/1922 Gilson ..... A42B 1/049 132/274
1,563,611 A * 12/1925 Cohen ..... A61F 9/045 2/209.5
1,612,750 A * 12/1926 Stake ..... A61F 9/045 2/209.5
1,685,263 A * 9/1928 Wolff ..... A42B 7/00 132/58
2,043,330 A * 6/1936 Nelkin ..... A42C 5/00 2/175.3
2,121,973 A * 6/1938 Lipton ..... A42B 7/00 132/58
2,185,306 A * 1/1940 Marks ..... A42B 1/22 2/209.3
2,377,320 A * 6/1945 Lipton ..... A42B 7/00 132/58
4,131,953 A * 1/1979 Kimotsuki ..... A42B 1/205 2/171.1
4,845,782 A * 7/1989 Gregg ..... A42B 7/00 2/172
4,993,079 A * 2/1991 Johnson ..... A42B 7/00 2/418

(Continued)

*Primary Examiner* — Heather Mangine
(74) *Attorney, Agent, or Firm* — Brian F. Russell

(57) ABSTRACT

A head cap with a removable back strap, comprising a crown, a visor, a back strap, one or more fastening mechanisms, and one or more stretchable components. The crown partly covers the head on the front side and includes one panel or multiple panels attached together in a preconfigured pattern. The back strap includes a first end and a second end, and is removably attached to the crown using the fastening mechanism that facilitates attaching and removing the back strap to the crown. Moreover, this two-part design allows for the interchangeability of headcaps (Part 1) with backstraps (Part 2) thus facilitating the use of an appropriate logo for the occasion. When reversed on the head, this head cap can appear as, and can become, a "bandana".

7 Claims, 3 Drawing Sheets

(56) References Cited

U.S. PATENT DOCUMENTS 5,099,524 A * 3/1992 Linday ..... A41D 20/00 2/171.1
5,119,514 A * 6/1992 Woehl ..... A42B 1/0188 2/172
5,144,695 A * 9/1992 Schweizer ..... A42B 3/08 2/209.13
5,325,540 A * 7/1994 Kronenberger ..... A42B 7/00 D2/896
5,432,955 A * 7/1995 Plotka ..... A42C 5/02 2/209.12
5,437,064 A * 8/1995 Hamaguchi ..... A42B 1/08 2/909
5,584,076 A * 12/1996 Armstrong ..... A42B 1/22 2/209.13
5,611,118 A * 3/1997 Bibbee ..... A42B 7/00 24/712
5,615,414 A * 4/1997 Landis ..... A42B 1/22 2/200.1
5,771,493 A * 6/1998 Proctor ..... A42B 1/004 2/171.1
D396,546 S * 8/1998 Marrs ..... D2/881
5,802,617 A * 9/1998 Boden ..... A42C 5/04 2/181.2
5,894,603 A * 4/1999 Capozzi ..... A42B 1/041 2/171.02
D416,665 S * 11/1999 Jones ..... D2/881
6,094,749 A * 8/2000 Proctor ..... A42B 1/248 2/171.1
6,240,566 B1 * 6/2001 Scantlin ..... A42B 1/225 2/209.13
6,240,570 B1 * 6/2001 Wu ..... A42B 1/08 2/DIG. 1
6,442,762 B1 * 9/2002 Neumann ..... A42B 7/00 132/58
6,446,266 B1 * 9/2002 Park ..... A42B 1/248 2/175.1
6,453,475 B1 * 9/2002 Johnson ..... A42B 1/22 2/209.12
D483,927 S * 12/2003 Appleberry ..... D2/882
6,658,664 B1 * 12/2003 Verhoeven ..... A42B 1/22 2/12
6,694,525 B1 * 2/2004 Murnan ..... A42B 3/227 2/421
D496,146 S * 9/2004 Appleberry ..... D2/881
D579,180 S * 10/2008 Bridges ..... D2/882
D615,453 S * 5/2010 Spears ..... D11/200
8,381,316 B2 * 2/2013 Edwards ..... A42B 1/006 297/393
D682,513 S * 5/2013 House ..... D2/876
9,364,369 B2 * 6/2016 Van Stone ..... A61F 5/3707
D768,964 S * 10/2016 York ..... D2/872
D780,412 S * 3/2017 Winton ..... D2/891
10,053,049 B1 * 8/2018 Carter ..... B64D 11/0646
11,497,268 B2 * 11/2022 Shaw ..... A42B 1/206
2002/0108165 A1 * 8/2002 Porter ..... A42B 1/24 2/209.13
2004/0163157 A1 * 8/2004 Kronenberger ..... A42B 1/22 2/171
2004/0226078 A1 * 11/2004 Lahman ..... A42B 3/00 2/418
2006/0090247 A1 * 5/2006 Cho ..... A61F 9/045 2/209.3
2006/0117460 A1 * 6/2006 Yan ..... A42B 1/225 2/209.3
2006/0272074 A1 * 12/2006 Fouts ..... A42B 7/00 2/175.7
2007/0199132 A1 * 8/2007 Lehmann ..... A42C 5/02 2/181
2008/0201825 A1 * 8/2008 Chun ..... A42B 1/225 2/209.13
2008/0282517 A1 * 11/2008 Claro ..... A45C 13/1069 24/303
2011/0107500 A1 * 5/2011 Wathen ..... A42B 1/0187 2/209.13
2012/0278970 A1 * 11/2012 Bischel ..... A42B 1/225 2/181
2013/0074246 A1 * 3/2013 Rogers ..... A42B 1/225 2/209.3
2013/0111650 A1 * 5/2013 Hong ..... A42B 1/225 2/209.13
2014/0026291 A1 * 1/2014 Webster ..... A41B 3/00 2/244
2014/0130235 A1 * 5/2014 Johnson ..... A42B 1/225 2/209.3
2016/0128417 A1 * 5/2016 Hickey ..... A42B 1/0182 2/195.1
2018/0007995 A1 * 1/2018 Morales ..... A41D 1/04
2018/0140033 A1 * 5/2018 Thornton ..... A42B 1/0182
2018/0325200 A1 * 11/2018 Tunison ..... A42C 1/00
2019/0133231 A1 * 5/2019 Stark ..... A42B 1/225
2019/0223538 A1 * 7/2019 Berg ..... A47H 13/00
2019/0289948 A1 * 9/2019 Moroy ..... A42B 1/248
2020/0068974 A1 * 3/2020 Schlabach ..... A42B 7/00
2020/0128898 A1 * 4/2020 Stark ..... A42B 1/22
2023/0389644 A1 * 12/2023 Bain ..... A42B 7/00

* cited by examiner

HEAD CAP WITH REMOVABLE BACKSTRAP AND METHOD OF USE

CROSS-REFERENCE TO RELATED APPLICATIONS

This application claims the benefit of U.S. Provisional Application 63/555,188 filed on Feb. 19, 2024, which is hereby incorporated by reference in its entirety.

BACKGROUND OF THE INVENTION

1. Field of the Invention

The present invention generally relates to accessories for the head, and more specifically, a head cap with a ball cap type of frontal section with visor and an accompanying backstrap that, when reversed (or simply turned around on the head) appears, serves as and becomes a bandana.

2. Background of the Related Art

A cap or hat is a headgear that made their first appearance as early as 3,200 BC. They were typically designed for warmth and often incorporated a visor to block the sun from the eyes.

A fact regarding the use of head accessories is that one's choice of a hat or headgear limits that person to the style and/or the configuration of the particular hat or headgear they chose.

SUMMARY OF THE INVENTION

An object of the invention is to solve at least the above problems and/or disadvantages and to provide at least the advantages described hereinafter.

Besides giving the choice of wearing or sporting a ballcap or, if in the mood, a bandana, the head cap of the present invention is interchangeable, meaning it provides a person with even more choices or options via the ability to mix and match a front part of the head cap with a back part of the head cap.

The present invention provides a head apparatus with removable backstraps and method of use that uses different backstraps and headcaps with visors interchangeably.

To achieve at least the above objects, in whole or in part, there is provided a head cap with a removable backstrap adapted to be worn by a user, comprising a crown adapted to partly cover the user's head on a front side, wherein the crown comprises one panel or multiple panels attached together in a preconfigured pattern, a visor in a curved configuration attached to and extending out in front of the crown, and at least one removable back strap comprising a first end, a second end, and one or more stretchable components, wherein the removable back strap is removably attached to the crown using one or more fastening mechanisms, wherein the stretchable components facilitate wearing the head cap around the user's head and helps prevents the head cap from moving around by providing a snug fit around the user's head.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The novel features believed to be characteristic of the embodiments of the present application are outlined in the appended claims. However, the embodiments themselves, as well as a preferred mode of use, and further objectives and advantages thereof, will best be understood by reference to the following detailed description when read in conjunction with the accompanying drawings, wherein:

Figure 1:
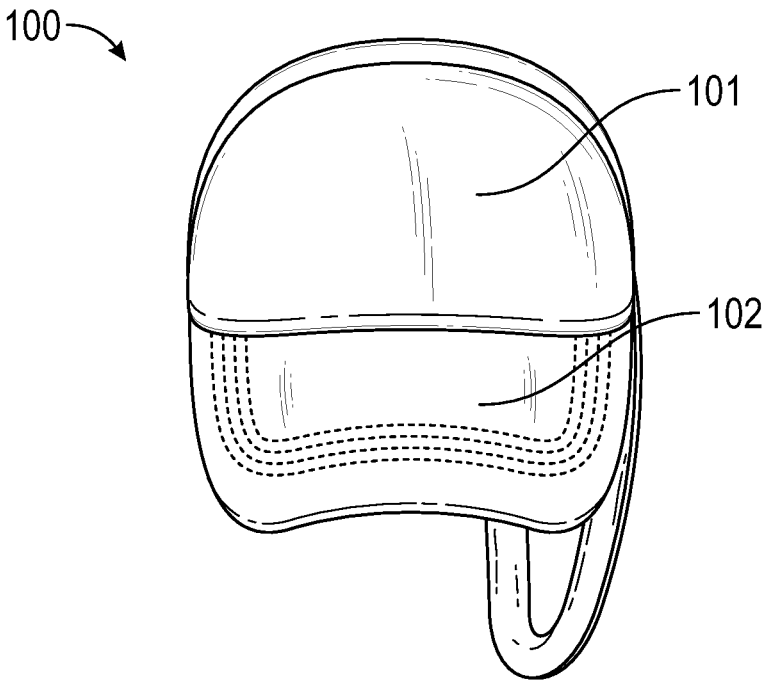
FIG. 1 is a perspective view of a head cap with a removable backstrap in accordance with one or more embodiments of the present invention.

While the head cap with a removable backstrap and method of use and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE INVENTION

Illustrative embodiments of the head cap with a removable backstrap and method of use and the method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The head cap with a removable backstrap and method of use in accordance with the present application overcomes one or more of the above-discussed problems commonly associated with head accessories. Specifically, the head cap with removable backstrap and method of use of the present invention facilitates users to use the head cap in a normal fashion, thus using the visor to shield their eyes from the sun. Moreover, the head cap of the present invention can be worn in a bandana style or fashion by simply turning it around and wearing the head cap of the present invention backwards. These and other unique features of the head cap with removable backstrap and method of use and its method of use are discussed below and illustrated in the accompanying drawings.

The head cap with removable backstrap of the present invention is a two-piece attachable/detachable, and therefore interchangeable, head apparatus. Said differently, Part 1 is a front ballcap style head apparatus that, via the use of various attachment mechanisms, attaches or detaches to Part 2 of the head cap of the present invention. Part 2 is the backstrap (e.g., bandana) that serves as a backstrap when the head cap of the present invention is worn in: (1) a forward frontal position—ball cap style with visor in a position to black sun from eyes; or (2) as a bandana when the head cap of the present invention is reversed or simply turned around on one's head and worn backwards or Bandana style The head cap with a removable backstrap and method of use of the present invention will be understood, both as to its structure and operation, from the accompanying drawings, taken in conjunction with the accompanying description. Several embodiments of the head cap with removable backstrap and method of use are presented herein. It should be understood that various components, parts, and features of the different embodiments may be combined and/or interchanged with one another, all of which are within the scope of the present application, even though not all variations and particular embodiments are shown in the drawings. It should also be understood that the mixing and matching of features, elements, and/or functions between various embodiments are expressly contemplated herein so that one of ordinary skill in the art would appreciate from this disclosure that the features, elements, and/or functions of one embodiment may be incorporated into another embodiment as appropriate unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
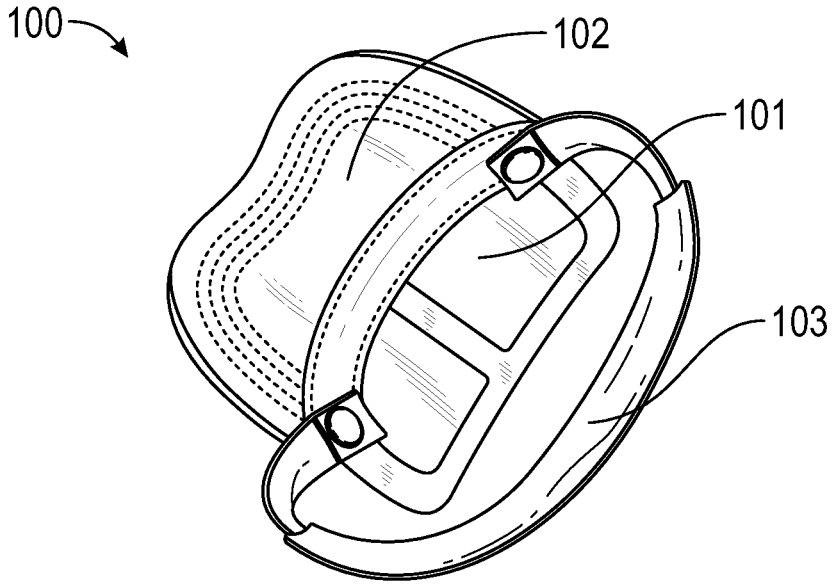
FIG. 2 is a perspective view of the inside of the head cap with a removable backstrap of FIG. 1.
Figure 3:
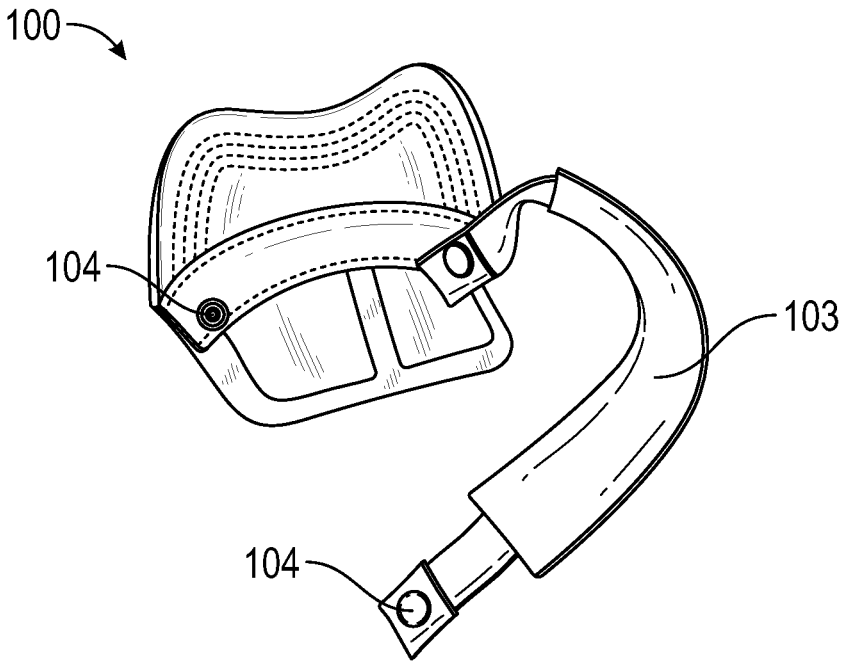
FIG. 3 is a back perspective view of the head cap of FIG. 1 with the back strap in a partially detached configuration.
Figure 4:
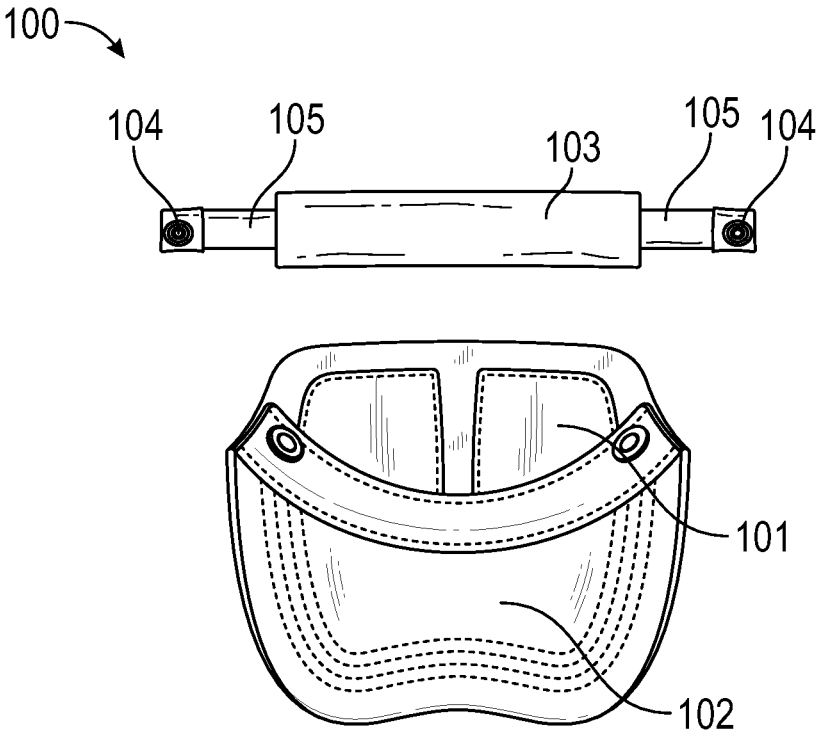
FIG. 4 is a back perspective view of the head cap of FIG. 1 with the back strap in a fully detached configuration.
Figure 5:
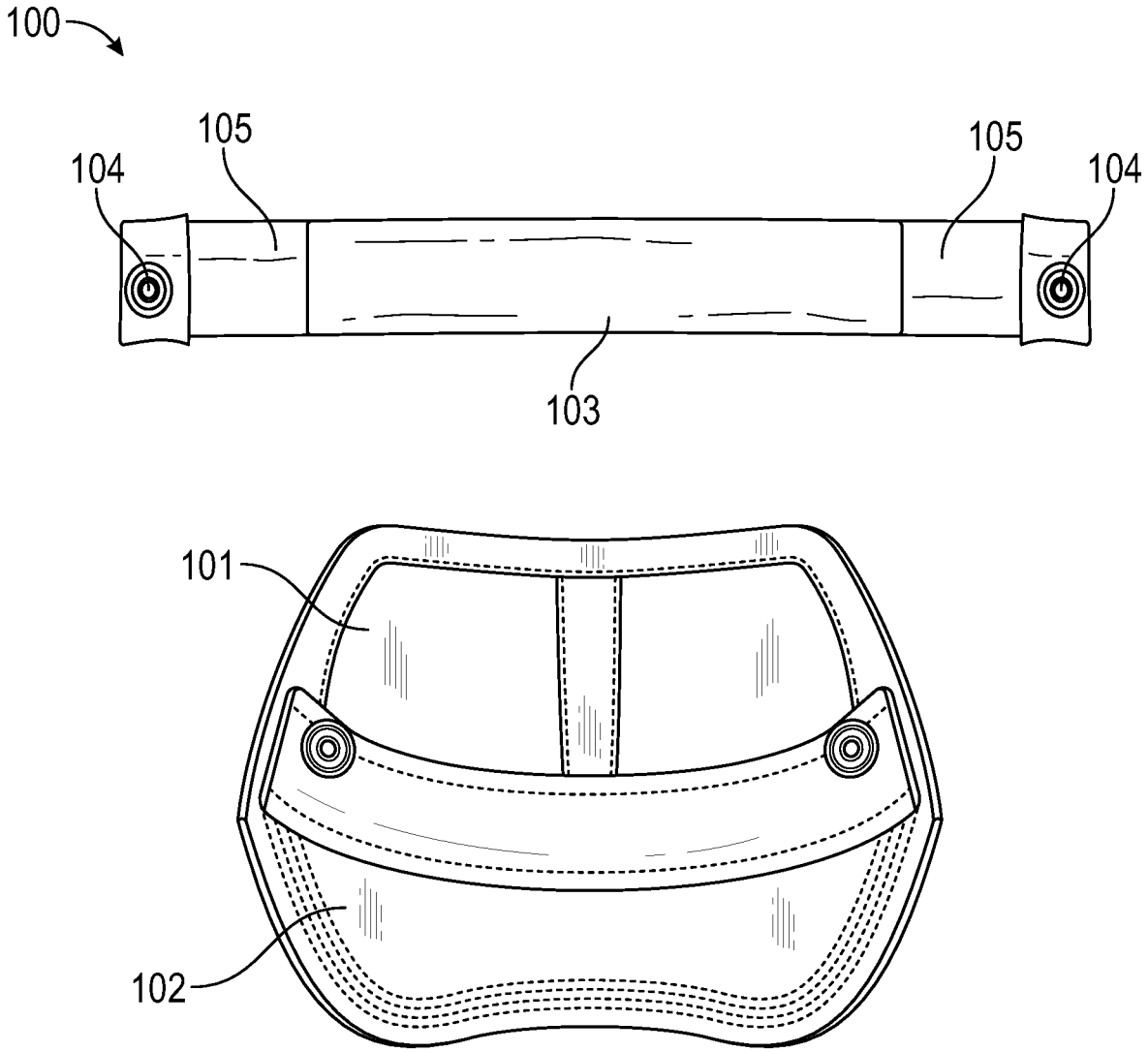
FIG. 5 is a back perspective view of the head cap of FIG. 1 with the back strap in a fully detached configuration according to another embodiment.

Referring now to the drawings wherein reference characters identify corresponding or similar elements throughout the several views, FIGS. 1-5 depict various views of a head cap with a removable backstrap 100 and method of use in accordance with an embodiment of the present application. It will be appreciated that the head cap with a removable backstrap 100 overcomes one or more of the above-listed problems commonly associated with head accessories. In addition, it should be appreciated that more or fewer of such components may be included in different embodiments of the head cap with a removable backstrap 100.

In the contemplated embodiment, the head cap with a removable backstrap 100 includes a crown 101 comprised of one or more panels on the front side and an inner band on the back side as shown in FIGS. 2-5, a visor 102, and one or more back straps or bandanas 103 with a first end and a second end, wherein the back strap or bandana 103 is removably attached to the inner band of the crown 101 using one or more fastening mechanisms 104. The crown 101 partly covers the head on the front side and is made of one or more panels stitched together in a preconfigured pattern such that it fits snugly around the head. The crown 101 has an attached visor 102 in a curved configuration extending out in front of the crown 101. The crown 101 may further include a plurality of eyelets.

The back strap 103 further includes one or more stretchable components 105 to facilitate wearing the cap around the head and preventing it from moving around by providing a snug fit around the head. The back strap 103 can be a single unit or multiple units adjoined with stretchable components 105. Alternatively, the entire back strap 103 can be constructed with stretchable material. The stretchability of the material used for the back strap 103 and/or the stretchable components 105 will effect the overall length of the back strap 103. For example, the higher the stretchability of the material used for the back strap 103, the shorter the backstrap can be.

The stretchable components 105 can be any size, but in one preferred embodiment they are 1.5" long and 2" wide, and can be sewn to the first end and second end of the back strap 103. Further, as discussed above, the entire back strap 103 can be constructed with stretchable material.

The back strap 103 can be of any length or width, but in one preferred embodiment it is 15" long overall and 2.375" wide, in the center, and 1" long and 2" wide at the first and second ends.

The crown 101 can be any shape or size, but in one preferred embodiment is is 4" high with a set of complementary components of the fastening mechanism affixed on the inside of the of the crown.

In one preferred embodiment, the first and second ends of the back strap include a set of complementary components of the fastening mechanism, to fit the other set of complementary components of the fastening mechanism affixed to the inside of the crown 101, as shown in FIGS. 2-5.

In one preferred embodiment, one or more back straps or bandanas 103 and one or more crowns 101 can be interchangeably used as a cap or bandana on the forehead as needed.

In one preferred embodiment, the fastening mechanism 104 can include, but is not limited to, one or more snap-fit fasteners, snap-on fasteners, hook and eye fasteners, clasp, buckle, hook and loop fasteners, or the use of VELCRO® and hook and chain fasteners.

In one preferred embodiment, the head cap with a removable backstrap 100 can be worn as a regular cap or can be worn in reverse as a bandana on the forehead.

In one preferred embodiment, the method of use of the head cap with a removable backstrap 100 involves attaching and detaching the backstrap 103 as desired using the fastening mechanism 104.

The head cap with a removable backstrap 100 can be in different colors, with one or more logos, one or more designs, or one or more indicia on the crown, visor, or backstrap, and can be made of any suitable material including but not limited to fabric, canvas, plastic, metal, acrylic, or a composite or blend of one or more materials. Multiple removable and interchangeable back straps 103 can be provided, each in different colors, with one or more logos, one or more designs, or one or more indicia.

It is also contemplated and will be appreciated that the head cap with a removable backstrap 100 facilitates the use of the cap for different occasions and activities, and allows one to sport or display whatever logo the occasion calls for. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as outlined in the description. Although the present embodiments are shown above, they are not limited to just these embodiments but are amenable to various changes and modifications without departing from the spirit thereof.

The invention claimed is:

1. A reversible headwear adapted to be worn by a user, comprising:

a crown adapted to partly cover the user's head on a front side, wherein the crown comprises one panel or multiple panels attached together in a preconfigured pattern;

the crown comprising an inner band extending on an inner side of the crown from a first band end at a right-most terminal end of the crown and terminating at a second band end at a left-most terminal end of the crown, the inner band having an upper edge and a surface configured to face the user's head;

the one or multiple panels of the crown extending upward past the upper edge of the inner band;

a visor in a curved configuration attached to and extending outward from a bottom edge of the crown and extending entirely across the bottom edge of the crown beginning at the right-most terminal end of the crown and terminating at the left-most end terminal of the crown; and at least one removable headband comprising a first end, a second end, and one or more stretchable components, wherein the first and second ends of the removable headband are removably attached to the first band end and the second band end of the inner band, respectively, using one or more fastening mechanisms attaching the first end second ends of the at least one removable head band directly to the surface of the inner band configured to face the user's head;

wherein the reversible headwear is adapted to be worn in a reverse configuration such that the removable headband is positioned on the user's forehead.

2. The reversible headwear of claim 1, wherein the one or more fastening mechanisms is selected from one or more of a group consisting of: snap-fit fasteners, snap-on fasteners, hook and eye fasteners, clasp, buckle, hook and loop fasteners, and hook and chain fasteners.

3. The reversible headwear of claim 1, wherein an entirety of the removable headband comprises the one or more stretchable components with the one or more fastening mechanisms on each of the first and second ends of the at least one removable headband.

4. The reversible headwear of claim 1, wherein a width of the at least one removable headband is between ½ inch and 4 inches.

5. The reversible headband/ballcap of claim 1, wherein the first and second ends of the at least one the removable headband comprises the one or more stretchable components.

6. The reversible headwear of claim 1, wherein the at least one removable headband incorporates one or more logos.

7. The reversible headwear of claim 1, wherein the at least one removable headband comprises a plurality of removable headbands, wherein each of the plurality of removable headbands comprises different colors, or on more logos, designs, or indicia.

* * * * *